US006382573B1

(12) United States Patent
Cepeda

(10) Patent No.: US 6,382,573 B1
(45) Date of Patent: May 7, 2002

(54) PORTABLE TRASH BAG SUPPORT DEVICE

(76) Inventor: David G. Cepeda, P.O. Box 10098, Sinajana, GU (US) 96926

( * ) Notice: Subject to any disclaimer, the term of this patent is extended or adjusted under 35 U.S.C. 154(b) by 0 days.

(21) Appl. No.: 09/675,137

(22) Filed: Sep. 29, 2000

(51) Int. Cl.[7] ..... B65B 67/12
(52) U.S. Cl. ..... 248/97; 248/99; 248/150
(58) Field of Search ..... 248/97, 99, 150, 248/165, 166, 907; 234/6, 5

(56) References Cited

U.S. PATENT DOCUMENTS

| | | | | | |
|---|---|---|---|---|---|
| 62,332 | A | * | 2/1867 | Heyden | 248/97 |
| 1,923,816 | A | * | 8/1933 | Firl | 248/97 |
| 2,677,518 | A | * | 5/1954 | Happy et al. | 248/150 |
| D216,438 | S | * | 1/1970 | Gay et al. | D34/6 |
| 3,638,888 | A | | 2/1972 | Ross | 248/97 |
| 4,138,139 | A | | 2/1979 | Alfonso | 280/652 |
| 4,783,031 | A | | 11/1988 | Ebentheuer | 248/97 |
| 4,927,104 | A | | 5/1990 | Miller | 248/97 |
| 5,183,226 | A | | 2/1993 | Brooks | 248/97 |
| 5,190,253 | A | * | 3/1993 | Sable | 248/97 |
| 5,456,431 | A | * | 10/1995 | Ilnisky | 248/98 |
| D389,632 | S | | 1/1998 | Reddin | D34/6 |
| 5,852,250 | A | * | 12/1998 | Cha | 84/327 |
| D411,361 | S | * | 6/1999 | Villarreal | D34/24 |
| D428,544 | S | * | 7/2000 | Moffitt et al. | D34/5 |

FOREIGN PATENT DOCUMENTS

| | | | | |
|---|---|---|---|---|
| CH | 56255 | * | 5/1911 | 248/97 |

* cited by examiner

*Primary Examiner*—Anita King
*Assistant Examiner*—Jonathan A Szumny

(57) ABSTRACT

A portable trash bag support device for effectively holding a trash bag in a trash-receiving upright position. The portable trash bag support device includes an upright support assembly including a first frame having a bottom end; and also includes a base assembly including a second frame having a back end which is hingedly attached to the bottom end of the first frame; and further includes a bag support assembly including a third frame having a back end which is hingedly attached to a top end of the first frame; and also includes a locking assembly for releasably locking the second and third frames outwardly of the first frame.

8 Claims, 3 Drawing Sheets

PORTABLE TRASH BAG SUPPORT DEVICE

BACKGROUND OF THE INVENTION

1. Field of the Invention

The present invention relates to a portable trash stand and more particularly pertains to a new portable trash bag support device for effectively holding a trash bag in a trash-receiving upright position.

2. Description of the Prior Art

The use of a portable trash stand is known in the prior art. More specifically, a portable trash stand heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,927,104; 3,638,888; 4,783,031; 4,138,139; 5,183,226; and U.S. Patent No. Des. 389,632.

While these devices fulfill their respective, particular objectives and requirements, the aforementioned patents do not disclose a new portable trash bag support device. The inventive device includes an upright support assembly including a first frame having a bottom end; and also includes a base assembly including a second frame having a back end which is hingedly attached to the bottom end of the first frame; and further includes a bag support assembly including a third frame having a back end which is hingedly attached to a top end of the first frame; and also includes a locking assembly for releasably locking the second and third frames outwardly of the first frame.

In these respects, the portable trash bag support device according to the present invention substantially departs from the conventional concepts and designs of the prior art, and in so doing provides an apparatus primarily developed for the purpose of effectively holding a trash bag in a trash-receiving upright position.

SUMMARY OF THE INVENTION

In view of the foregoing disadvantages inherent in the known types of portable trash stand now present in the prior art, the present invention provides a new portable trash bag support device construction wherein the same can be utilized for effectively holding a trash bag in a trash-receiving upright position.

The general purpose of the present invention, which will be described subsequently in greater detail, is to provide a new portable trash bag support device which has many of the advantages of the portable trash stand mentioned heretofore and many novel features that result in a new portable trash bag support device which is not anticipated, rendered obvious, suggested, or even implied by any of the prior art portable trash stand, either alone or in any combination thereof.

To attain this, the present invention generally comprises an upright support assembly including a first frame having a bottom end; and also includes a base assembly including a second frame having a back end which is hingedly attached to the bottom end of the first frame; and further includes a bag support assembly including a third frame having a back end which is hingedly attached to a top end of the first frame; and also includes a locking assembly for releasably locking the second and third frames outwardly of the first frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable trash bag support device which has many of the advantages of the portable trash stand mentioned heretofore and many novel features that result in a new portable trash bag support device which is not anticipated, rendered obvious, suggested, or even implied by any of the prior art portable trash stand, either alone or in any combination thereof.

It is another object of the present invention to provide a new portable trash bag support device which may be easily and efficiently manufactured and marketed.

It is a further object of the present invention to provide a new portable trash bag support device which is of a durable and reliable construction.

An even further object of the present invention is to provide a new portable trash bag support device which is susceptible of a low cost of manufacture with regard to both materials and labor, and which accordingly is then susceptible of low prices of sale to the consuming public, thereby making such portable trash bag support device economically available to the buying public.

Still yet another object of the present invention is to provide a new portable trash bag support device which provides in the apparatuses and methods of the prior art some of the advantages thereof, while simultaneously overcoming some of the disadvantages normally associated therewith.

Still another object of the present invention is to provide a new portable trash bag support device for effectively holding a trash bag in a trash-receiving upright position.

Yet another object of the present invention is to provide a new portable trash bag support device which includes an upright support assembly including a first frame having a bottom end; and also includes a base assembly including a second frame having a back end which is hingedly attached to the bottom end of the first frame; and further includes a bag support assembly including a third frame having a back end which is hingedly attached to a top end of the first frame; and also includes a locking assembly for releasably locking the second and third frames outwardly of the first frame.

Still yet another object of the present invention is to provide a new portable trash bag support device that can be easily and quickly collapsed for storage or transporting.

Even still another object of the present invention is to provide a new portable trash bag support device that can be easily and quickly set up for use anywhere.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
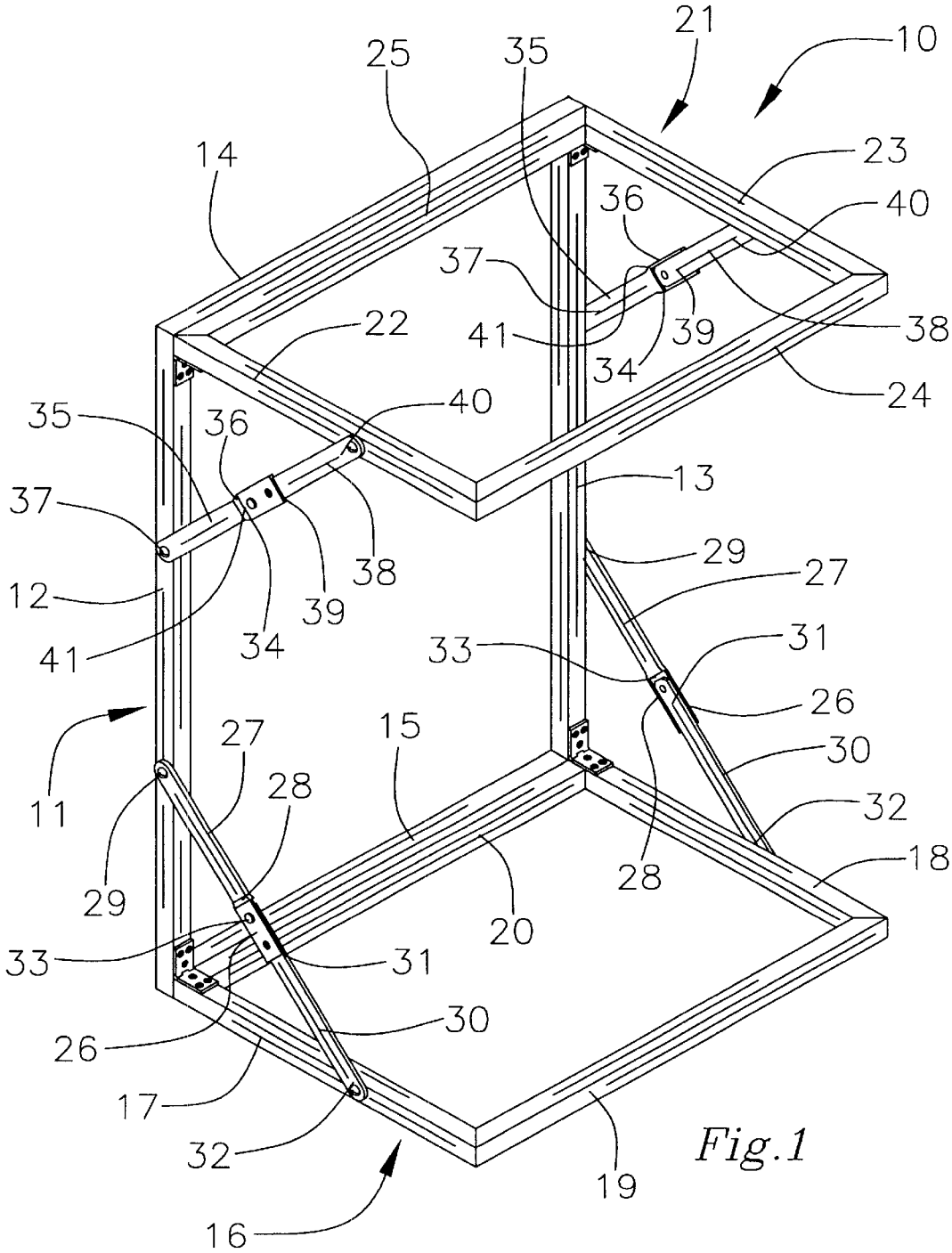
FIG. 1 is a perspective view of a new portable trash bag support device according to the present invention and being set up.
Figure 2:
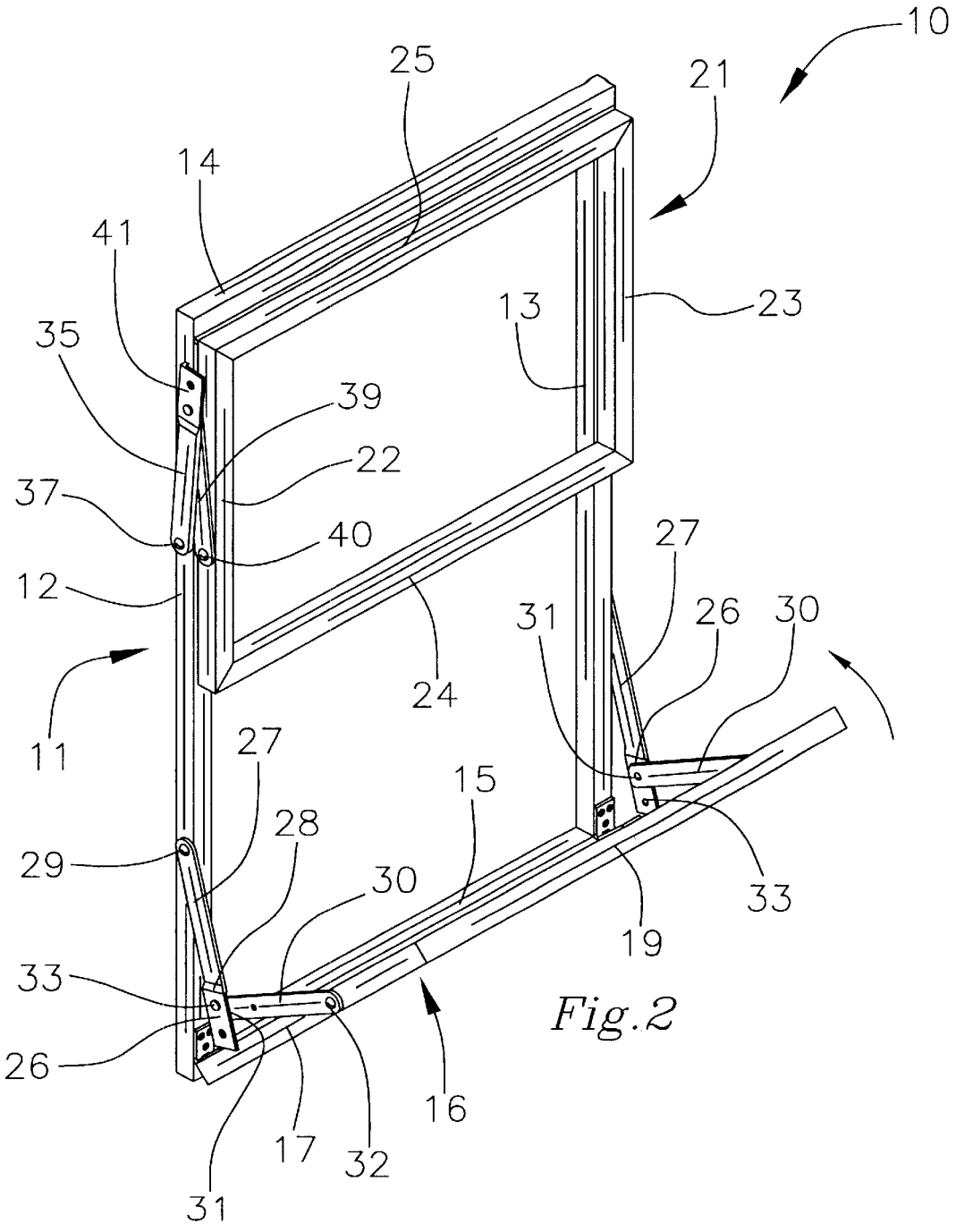
FIG. 2 is a perspective view of the present invention in a transportable position.
Figure 3:
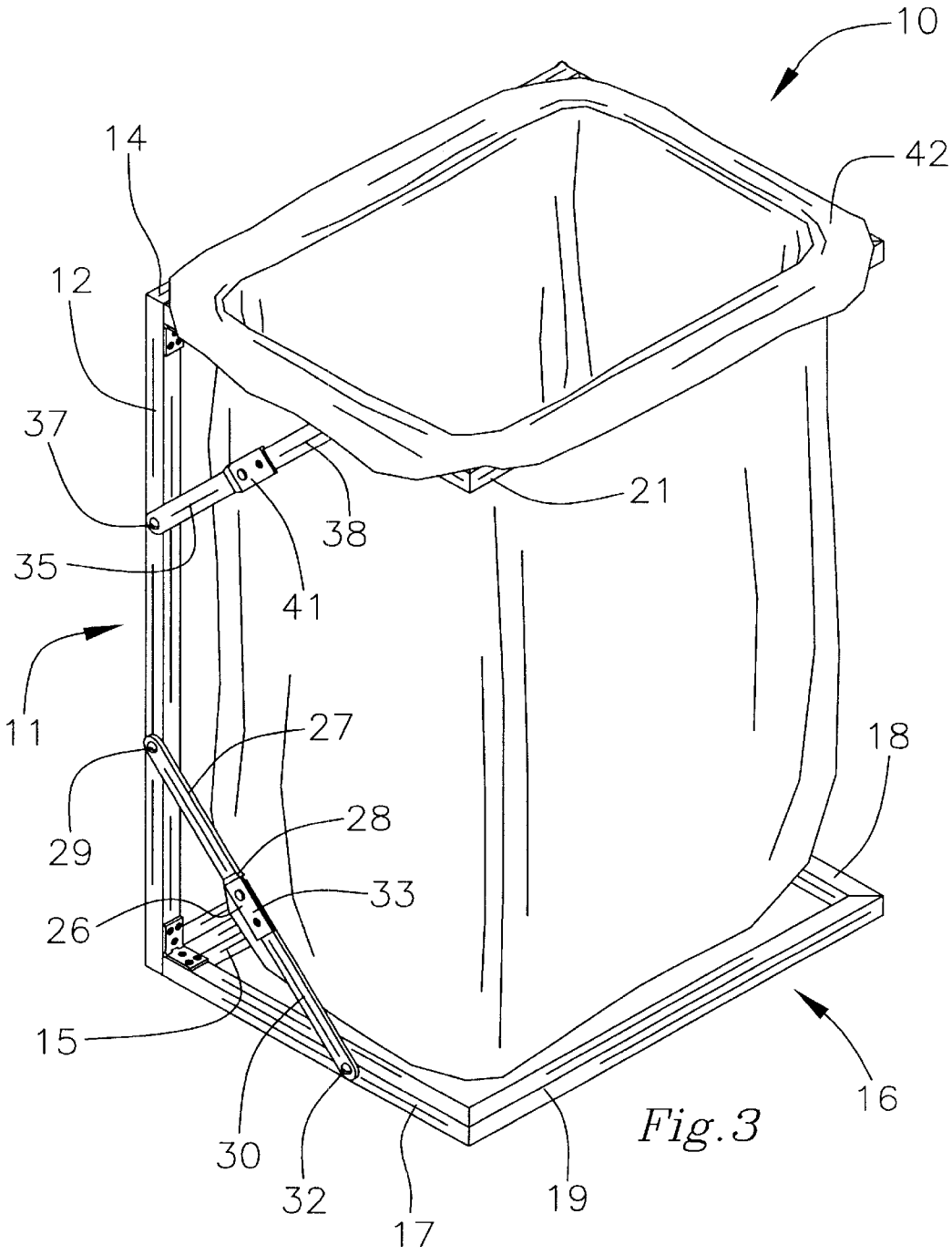
FIG. 3 is a perspective view of the present invention shown in use.

With reference now to the drawings, and in particular to FIGS. 1 through 3 thereof, a new portable trash bag support device embodying the principles and concepts of the present invention and generally designated by the reference numeral 10 will be described.

As best illustrated in FIGS. 1 through 3, the portable trash bag support device 10 generally comprises an upright support assembly including a first frame 11 having a bottom end with the first frame 11 including elongate side members 12,13 being spaced apart and also including top and bottom cross members 14,15 being securely and conventionally attached at respective ends of the elongate side members 12,13 and extending therebetween.

The portable trash bag support device 10 also comprises a base assembly including a second frame 16 having a back end which is hingedly and conventionally attached to the bottom end of the first frame 11. The second frame 16 includes elongate side members 17,18 being spaced apart and also includes front and back cross members 19,20 being securely and conventionally attached at respective ends of the elongate side members 17,18 of the second frame 16 and extending therebetween.

The portable trash bag support device 10 further comprises a bag support assembly including a third frame 21 having a back end which is hingedly and conventionally attached to a top end of the first frame 11. The third frame 21 includes elongate side members 22,23 being spaced apart and also includes front and back cross members 24,25 being securely and conventionally attached at respective ends of the elongate side members 22,23 of the third frame 21 and extending therebetween. The elongate side members 22,23 and the front and back cross members 24,25 of the third frame 21 are adapted to support a trash bag 42 draped thereupon.

The portable trash bag support device 10 also comprises a locking assembly for releasably locking the second and third frames 16,21 outwardly of the first frame 11 such that the base assembly rests upon a ground. The locking assembly includes a plurality of locking members 26,34 having ends pivotally attached to the elongate side members 12,13, 17,18,22,23 of the frames 11,16,21 with the locking members 26,34 including a pair of first locking members 26 each of which includes a first linkage member 27 having a first end 28 and a second end 29 which is pivotally and conventionally attached to a respective elongate side member 12,13 of the first frame 11. Each of the first locking members 26 also includes a second linkage member 30 having a first end 31 and a second end 32 which is pivotally and conventionally attached to a respective elongate side member 17,18 of the second frame 16. The first ends 28 of the first linkage members 27 are pivotally and conventionally attached to the first ends 31 of the second linkage members 30. Each of the first locking members 26 further includes a locking mechanism 33 being securely and conventionally attached at the first ends 28 of the first linkage members 27 for locking the first and second linkage members 27,30 together. The locking members 26,34 include a pair of second locking members 34 each of which includes a first linkage member 35 having a first end 36 and a second end 37 which is pivotally and conventionally attached to a respective elongate side member 12,13 of the first frame 11. Each of the second locking members 34 also includes a second linkage 38 member having a first end 39 and a second end 40 which is pivotally and conventionally attached to a respective elongate side member 22,23 of the third frame 21. The first ends 36 of the first linkage members 35 of the second locking members 34 are pivotally and conventionally attached to the first ends 39 of the second linkage members 38 of the second locking members 34. Each of the second locking members 34 further includes a locking mechanism 41 being securely and conventionally attached at the first ends 36 of the first linkage members 35 of the second locking members 34 for locking the first and second linkage members 35,38 of the second locking members 34 together.

In use, the user extends and locks the second frame 16 approximately ninety degrees from the first frame 11 and also extends and locks the third frame 21 approximately ninety degrees from the first frame 11 and rests the second frame 16 upon a ground surface such that a trash bag 42 is draped about the third frame 21 such that the user can conveniently place garbage in the trash bag 42 through the opening therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable trash bag support device comprising:

an upright support assembly including a first frame having a top end and a bottom end, said first frame having a pair of side members;

a base assembly including a second frame having a back end which is pivotally attached to said bottom end of said first frame such that said second frame is pivotable between a stored position and a deployed position, said second frame having a pair of side members;

a bag support assembly including a third frame having a back end which is pivotally attached to said top end of said first frame such that said third frame is pivotable between a stored position and a deployed position, said third frame having side members; and a locking assembly for releasably locking each of said second and third frames in said deployed position;

wherein said deployed position of said second and third frames is characterized by said frames extending substantially perpendicular to a plane of said first frame, and wherein said storage position is characterized by said second and third frames being oriented substantially parallel to the plane of said first frame and said second and third frames are located in substantially the same plane, the side members of said second and third frames being positioned adjacent to and abutting the side members of said first frame.

2. The portable trash bag support device as described in claim 1, wherein said first frame includes elongate side members being spaced apart and also includes top and bottom cross members being attached at respective ends of said elongate side members and extending therebetween.

3. The portable trash bag support device as described in claim 1, wherein said second frame includes elongate side members being spaced apart and also includes front and back cross members being attached at respective ends of said elongate side members of said second frame and extending therebetween.

4. The portable trash bag support device as described in claim 1, wherein said third frame includes elongate side members being spaced apart and also includes front and back cross members being attached at respective ends of said elongate side members of said third frame and extending therebetween, said elongate side members and said front and back cross members of said third frame being adapted to support a trash bag draped thereupon.

5. The portable trash bag support device as described in claim 1, wherein said locking assembly includes a plurality of locking members having ends pivotally attached to side members of said frames, said ends of said locking members being mounted on laterally outer surfaces of said side members such that locking members are not positioned between the side members of said frames when said second and third frames are positioned in said storage position.

6. The portable trash bag support device as described in claim 5, wherein said locking members include a pair of first locking members each of which includes a first linkage member having a first end and a second end which is pivotally attached to a respective said elongate side member of said first frame, each of said first locking members also including a second linkage member having a first end and a second end which is pivotally attached to a respective said elongate side member of said second frame, said first ends of said first linkage members being pivotally attached to said first ends of said second linkage members, each of said first locking members further including a locking mechanism being securely attached at said first ends of said first linkage members for locking said first and second linkage members together.

7. The portable trash bag support device as described in claim 6, wherein said locking members include a pair of second locking members each of which includes a first linkage member having a first end and a second end which is pivotally attached to a respective said elongate side member of said first frame, each of said second locking members also including a second linkage member having a first end and a second end which is pivotally attached to a respective said elongate side member of said third frame, said first ends of said first linkage members of said second locking members being pivotally attached to said first ends of said second linkage members of said second locking members, each of said second locking members further including a locking mechanism being securely attached at said first ends of said first linkage members of said second locking members for locking said first and second linkage members of said second locking members together.

8. A portable trash bag support device comprising:

an upright support assembly including a first frame having a top end and a bottom end, said first frame having a pair of side members;

a base assembly including a second frame having a back end which is pivotally attached to said bottom end of said first frame such that said second frame is pivotable between a stored position and a deployed position, said second frame having a pair of side members;

a bag support assembly including a third frame having a back end which is pivotally attached to said top end of said first frame such that said third frame is pivotable between a stored position and a deployed position, said third frame having side members; and a locking assembly for releasably locking each of said second and third frames in said deployed position;

wherein said deployed position of said second and third frames is characterized by said frames extending substantially perpendicular to a plane of said first frame, and wherein said storage position is characterized by said second and third frames being oriented substantially parallel to the plane of said first frame and said second and third frames are located in substantially the same plane, the side members of said second and third frames being positioned adjacent to and abutting the side members of said first frame;

wherein said first frame includes elongate side members being spaced apart and also includes top and bottom cross members being attached at respective ends of said elongate side members and extending therebetween;

wherein said second frame includes elongate side members being spaced apart and also includes front and back cross members being attached at respective ends of said elongate side members of said second frame and extending therebetween;

wherein said third frame includes elongate side members being spaced apart and also includes front and back cross members being attached at respective ends of said elongate side members of said third frame and extending therebetween, said elongate side members and said front and back cross members of said third frame being adapted to support a trash bag draped thereupon;

wherein said locking assembly includes a plurality of locking members having ends pivotally attached to side members of said frames, said ends of said locking members being mounted on laterally outer surfaces of said side members such that locking members are not positioned between the side members of said frames when said second and third frames are positioned in said storage position;

wherein said locking members include a pair of first locking members each of which includes a first linkage member having a first end and a second end which is pivotally attached to a respective said elongate side member of said first frame, each of said first locking members also including a second linkage having a first end and a second end Which is pivotally attached to a respective said elongate side member of said second frame, said first ends of said first linkage members being pivotally attached to said first ends of said second linkage members, each of said first locking members further including a locking mechanism being securely attached at said first ends of said first linkage members for locking said first and second linkage members together; and wherein said locking members include a pair of second locking members each of which includes a first linkage member having a first end and a second end which is pivotally attached to a respective said elongate side member of said first frame, each of said second locking members also including a second linkage member having a first end and a second end which is pivotally attached to a respective said elongate side member of said third frame, said first ends of said first linkage members of said second locking members being pivotally attached to said first ends of said second linkage members of said second locking members, each of said second locking members further including a locking mechanism being securely attached at said first ends of said first linkage members of said second locking members for locking said first and second linkage members of said second locking members together.

* * * * *